United States Patent [19]

Powell

[11] Patent Number: 4,897,009

[45] Date of Patent: Jan. 30, 1990

[54] DRILL PIPE HANDLING APPARATUS

[75] Inventor: Michael S. Powell, Boonville, Ind.

[73] Assignee: Peabody Coal Company, St. Louis, Mo.

[21] Appl. No.: 293,708

[22] Filed: Jan. 5, 1989

[51] Int. Cl.[4] ..... E21B 19/14

[52] U.S. Cl. ..... 414/22.66; 166/85; 175/52; 175/85; 211/70.4

[58] Field of Search ..... 414/22.51, 22.53, 22.63, 414/22.65, 22.66, 22.67, 22.68, 22.69, 22.71, 745.2, 745.7, 745.8; 166/77.5, 85; 175/52, 85; 211/70.4, 69, 68

[56] References Cited

U.S. PATENT DOCUMENTS

| | | | |
|---|---|---|---|
| 2,909,288 | 10/1959 | Boudette | 414/22.66 X |
| 2,972,388 | 2/1961 | Thornburg | 414/22.66 X |
| 3,025,918 | 3/1962 | Leven | 175/52 |
| 3,684,039 | 8/1972 | Coyne | 175/52 X |
| 3,913,753 | 10/1975 | Swartz et al. | 414/22.66 |
| 3,966,053 | 6/1976 | Loftis | 175/85 X |
| 3,985,189 | 10/1976 | Jahnke et al. | 414/22.66 X |
| 4,455,116 | 6/1984 | Lindstedt et al. | 414/22.66 |

*Primary Examiner*—Frank E. Werner
*Assistant Examiner*—James T. Eller
*Attorney, Agent, or Firm*—Senniger, Powers, Leavitt and Roedel

[57] ABSTRACT

Drill pipe handling apparatus including a magazine for holding a plurality of lengths of drill pipe and delivering each pipe into position for its removal by drilling apparatus which is operable to drill the pipe into the ground at an angle off vertical, having a brake for preventing rotation of the magazine such as might otherwise occur due to the magazine being in an unbalanced condition.

14 Claims, 7 Drawing Sheets

DRILL PIPE HANDLING APPARATUS

BACKGROUND OF THE INVENTION

This invention relates to drill pipe handling apparatus, and more particularly to drill pipe handling apparatus used for off vertical drilling.

The invention is especially concerned with drill pipe handling apparatus in which a plurality of drill pipes are held in a magazine and successively fed into the drilling apparatus. The magazine of the handling apparatus has a center shaft and upper and lower heads which hold the drill pipes around the shaft. The magazine is rotated about the shaft to bring the next drill pipe into position for feeding into the drilling apparatus. The entire magazine is swung into the drilling apparatus to feed the positioned drill pipe to the drilling apparatus. The drilling apparatus is positioned at an angle off vertical for drilling at an angle and, therefore, the magazine is positioned at an angle off vertical so that the pipes will be properly aligned when fed into drilling apparatus. When the magazine is fully loaded with drill pipes, it is balanced for relatively easy control despite the great weight of the pipes. However, once one of the pipes is removed, the magazine becomes unbalanced causing the magazine to tend to rotate too far and misalign the next drill pipe. Drilling is delayed while the magazine is rotated completely around the center shaft to position the pipe after over-rotation occurs. Frequently, several attempts must be made before the pipe is properly positioned. One approach for preventing such over-rotation of the magazine has been to provide braking means for the magazine shaft, but the braking means which has been used has had the problem of being unable effectively to hold the shaft against rotation, particularly when the shaft is wet or oily as it often is, and of braking or jamming the handling apparatus if tightened in an effort to hold the shaft.

SUMMARY OF THE INVENTION

Among the several objects of this invention may be noted the provision of drill pipe handling apparatus, as described, which consistently positions drill pipe for feeding into drilling apparatus without over-rotation; the provision of drill pipe handling apparatus which will position the next drill pipe for feeding into the drilling apparatus without over-rotation under conditions in which the shaft is wet or oily; and the provision of a drill pipe handling apparatus with an improved brake which may be tightened against the shaft for maximum braking force without jamming the handling apparatus or causing the brake to fail.

In general, the invention involves drill pipe handling apparatus comprising a magazine for holding a plurality of lengths of drill pipe and delivering each pipe into position for its removal by drilling apparatus which is operable to drill the pipe into the ground at an angle off vertical. The magazine has a center shaft and upper and lower heads on the shaft which have means for holding a plurality of pipes in position generally parallel to the center shaft with each pipe adapted to be removed from the magazine by the drilling apparatus. Means supports the shaft for movement of the magazine relative to the drilling apparatus, with the shaft at an angle off vertical, between a retracted position relative to the drilling apparatus and a delivery position. In the delivery position, a pipe is aligned with the drilling apparatus for removing the pipe from the magazine. Means is provided for rotation of the magazine relative to the supporting means for successively bringing pipes held by the magazine into position for being removed from the magazine by the drilling apparatus. The drill pipe handling apparatus is provided with means for holding the shaft against rotation such as might otherwise occur when the magazine is in retracted position due to the shaft being at an angle off vertical and thereby unbalanced, generally comprising a brake for the shaft located below the lower head. The brake has two generally interiorly semicylindrical brake shoes pivotally interconnected for swinging movement relative to one another on an axis generally parallel to the shaft axis between an open position for application thereof around the shaft and removal thereof from the shaft and a closed position surrounding the shaft. In the closed position, the interior semicylindrical surfaces of said shoes are in frictional engagement with the shaft to prevent rotation of the shaft such as might otherwise occur when the magazine is in retracted position due to the shaft being at an angle off vertical and the magazine thereby being unbalanced. Despite their frictional engagement with the shaft, the brake shoes in the closed position enable rotation of the magazine for successively bringing pipes held in the magazine into position for being removed from the magazine by the drilling apparatus. The brake includes means for attachment of the shoes to the supporting means for the shaft below the lower head. Spring means draws the two shoes together when the shoes are applied around the shaft. The spring means is disengageable from the shoes for the opening of the shoes and engageable with the shoes following application of the shoes around the shaft.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 5:
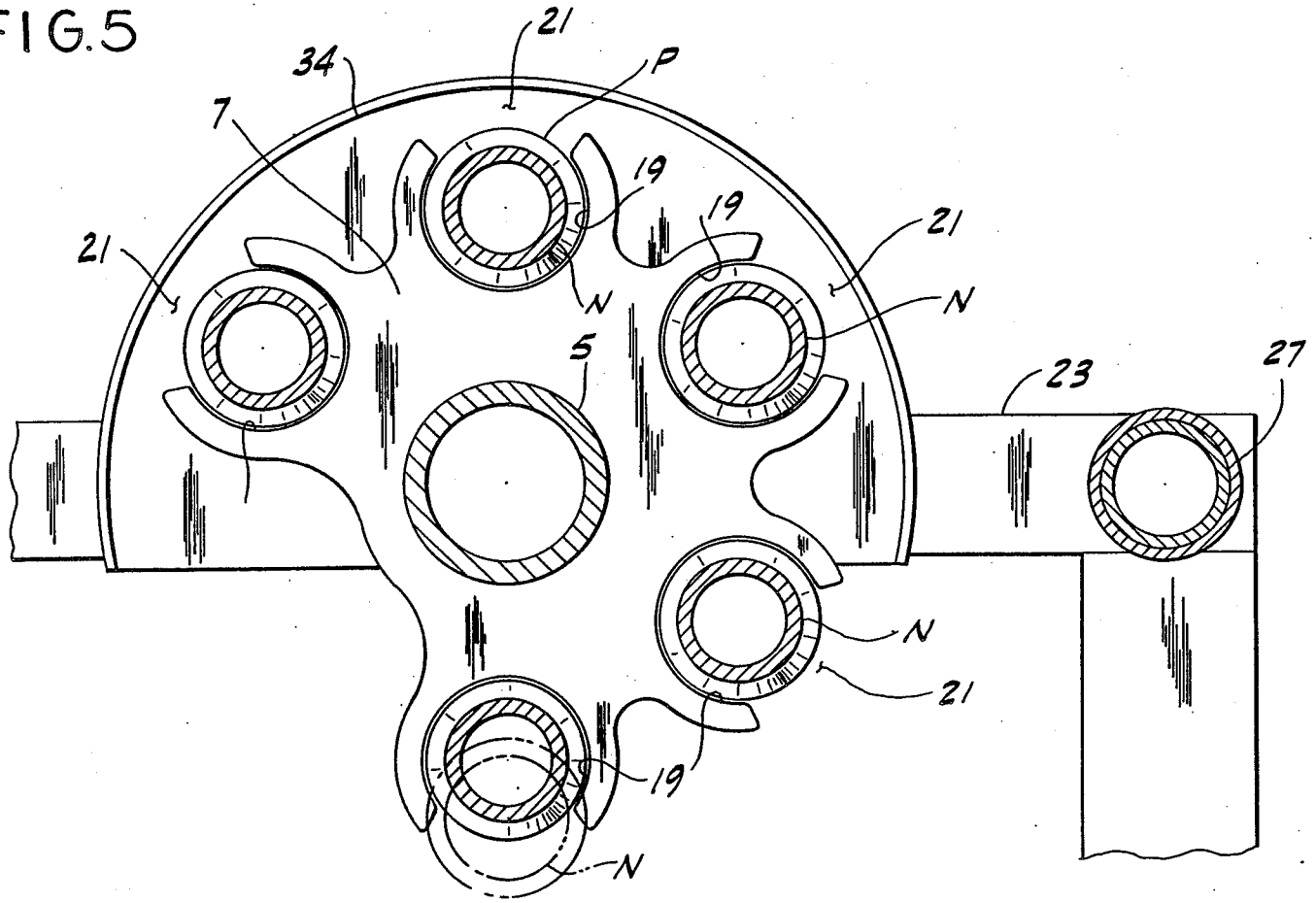
FIG. 5 is a view in section on line 5—5 of FIG. 2.

Referring to the drawings, there is generally indicated at 1 drill pipe handling apparatus having a magazine 3. The latter holds, in this embodiment, five lengths of drill pipe P and delivers each pipe into position for its removal by drilling apparatus, indicated generally at D, which is operable to drill the pipe into the ground at an angle off vertical. The drilling apparatus includes a frame F, a dust skirt T and a mobile platform M. The magazine includes a center shaft 5 having an upper head 7 and a lower head 9 spaced axially on the shaft. The heads have means for holding the five drill pipes generally parallel to the center shaft, this means comprising five cups 15, mounted on the lower head by means of bolts 17, each open at the top for receiving the lower end of a drill pipe therein. The upper head, as shown in FIG. 5, comprises a plate having five notches 19 corresponding to and aligned with the cups 15 on the lower head. The mouth 21 of each notch is narrower than the outer diameter of the upper end of the pipe so that when the upper end of the pipe is placed in the upper head it is held in the notch. The pipe has a neck portion N just below its upper end of smaller diameter than the width of the mouth. As shown in phantom in FIG. 5, the pipe may pass through the mouth of the notch when the pipe is raised to register the neck portion with the notch.

Means for supporting the magazine shaft 5 is shown to comprise an upper arm 23, a lower arm 25 and a support shaft 27. The arms are mounted on the support shaft 27 which is in turn mounted on the elongated frame F which also supports the drill rigging of the drilling apparatus D. The frame is positioned at an angle off vertical so that the drilling apparatus can drill at an angle into the ground. The support shaft is rotatable about its axis 29, which is at an angle off vertical, to swing the magazine 3 between a retracted position relative to the drilling apparatus (shown in FIG. 1) and a delivery position (shown in FIG. 2). Swinging of the magazine is effected by hydraulic means 33 on the frame. In the delivery position, a pipe P is aligned in the frame of the drilling apparatus for removal of the pipe from the magazine by the drilling apparatus, and the magazine shaft 5 is rotatable about its own axis 31 successively to bring the drill pipes held in the magazine into position for being removed from the magazine by the drilling apparatus. The upper arm 23 has a semicircular plate 34 for covering the tops of the pipes in the magazine which are not in the delivery position or the position immediately prior to the delivery position.

Figure 7:
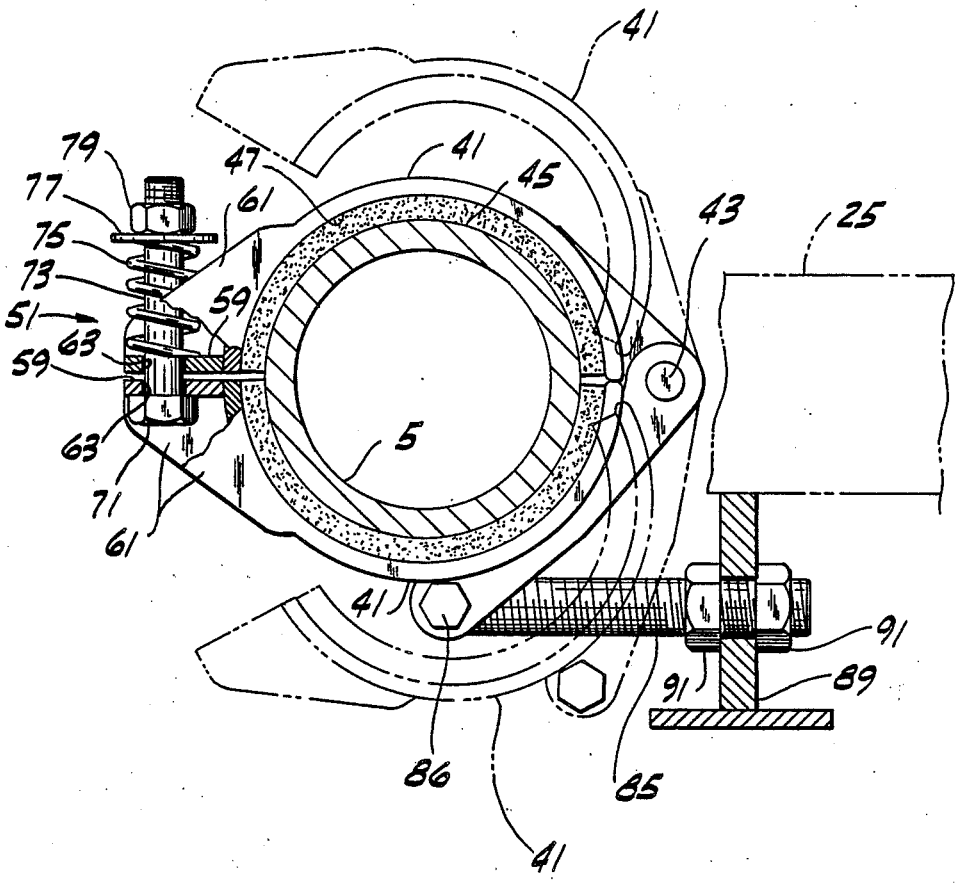
FIG. 7 is a view in section on line 7—7 of FIG. 4 with parts broken away to reveal the holding means.

Means is provided for holding the magazine shaft 5 against the rotation which may occur when the magazine 3 is only partially loaded and out of rotational balance because the magazine shaft is at an angle off vertical. The holding means comprises a brake, indicated generally at 35, for the magazine shaft located below the lower head 9 and the lower arm 25, and which has two interiorly semicylindrical brake shoes 41 pivotally interconnected at one end by a pin 43 for swinging movement about the pin on an axis generally parallel to the magazine shaft axis 31. The shoes pivot between an open position (shown in phantom in FIG. 7) for applying the shoes around the magazine shaft and removing them from the shaft, and a closed position (shown in solid lines in FIG. 7). Brake lining material 45 is secured by rivets to the interior semicylindrical surfaces 47 of the brake shoes and covers the entire surface of each shoe. In the closed position, the interior surfaces 47 of the brake shoes define a cylinder which surrounds the magazine shaft, and substantially all of the surface area of the pipe that is enclosed by the brake shoes is frictionally engaged by the brake lining.

The brake shoes 41 are held in a substantially closed position by spring means, indicated generally at 51 which acts to draw the two shoes together when the shoes are applied around the magazine shaft 5. The spring means may be disengaged from the shoes to allow the shoes to be opened, and engaged with the shoes following application of the shoes around the shaft. The spring means is generally disposed at the free ends of the brake shoes, generally opposite the pin 43 interconnecting the shoes. Two members or lugs 59 extend radially outwardly from the free ends of the brake shoes. Each lug lies generally in a plane containing the axis of the pin 43. There are also two axially separated reinforcing plates or gussets 61 for each lug extending radially outwardly from the shoe. The plates are in planes generally perpendicular to the axis of the pin, and are integrally connected to the lugs 59 at the axially upper and lower sides of the lugs 59 respectively. Openings 63 in the lugs are aligned when the free ends of the brake shoes are drawn together so that the lugs abut each other.

The spring means 51 includes a bolt generally indicated at having a head 71 and a threaded shank 73. The shank is received through the openings 63 in the lugs 59 when the brake shoes 41 are substantially closed. A helical coil compression spring 75 is disposed on the shank so that the lugs are located between one end of the spring and the bolt head. A washer 77 fits on the shank and engages the end of the spring 75 opposite the lugs. The washer is forced against the spring by a nut 79 threaded on the shank. The clamping action between the spring 75 and the bolt head biases the brake shoes toward a closed position.

The brake lining 45 will decrease in thickness because of wear in continuous use of the brake 35. In order to maintain a relatively constant braking force on the magazine shaft, the spring means 51 may be adjusted by tightening nut 79. In addition, the cross sectional area enclosed by the brake shoes in their fully closed position is less than the cross sectional area of the magazine shaft. Therefore, the shoes can be closed more fully to compensate for the reduction in thickness of the brake lining. However, it is undesirable for the brake shoes to be overtightened, which results, at the least, in increased wear on the brake lining. Further, the brake may become so tight that the magazine shaft will not be able to be rotated to bring the next pipe into position, or the brake may fail under high torsional loading during rotation of the magazine shaft. Overtightening of the brake is avoided by having the threads extend only part of the way up the shank 73 from the end of the bolt opposite the head 71. There is then a limit of the motion of the nut 79 toward the bolt head 71 and therefore a limit on the compression of the spring 75. The spring 75 provides further protection against overtightening in that it functions as a resilient clamp which will yield through further compression when the load on the brake reaches high levels.

A threaded rod 85 is provided for releasably attaching the brake shoes 41 to the support means for preventing rotation of the brake shoes relative to the support means. The first end of the rod is pivotally mounted on one of the brake shoes by a pin 86 and may swing in a plane perpendicular to the magazine shaft axis 31 for facilitating application of the brake shoes around the magazine shaft 5 and removal of the brake shoes from the shaft. The second end of the rod passes through a hole in a plate 89 mounted on the lower arm 25 and located below the lower arm. Two nuts 91 having diameters larger than that of the hole in the attachment plate 89 are threaded on the rod on either side of the plate to secure the rod to the plate and hence to the supporting means (the rod and the nuts 91 comprise the fastening means in this embodiment). The brake may be released from the plate 89 by removing the nut 91 on the opposite side of the plate from the brake.

Figure 6:
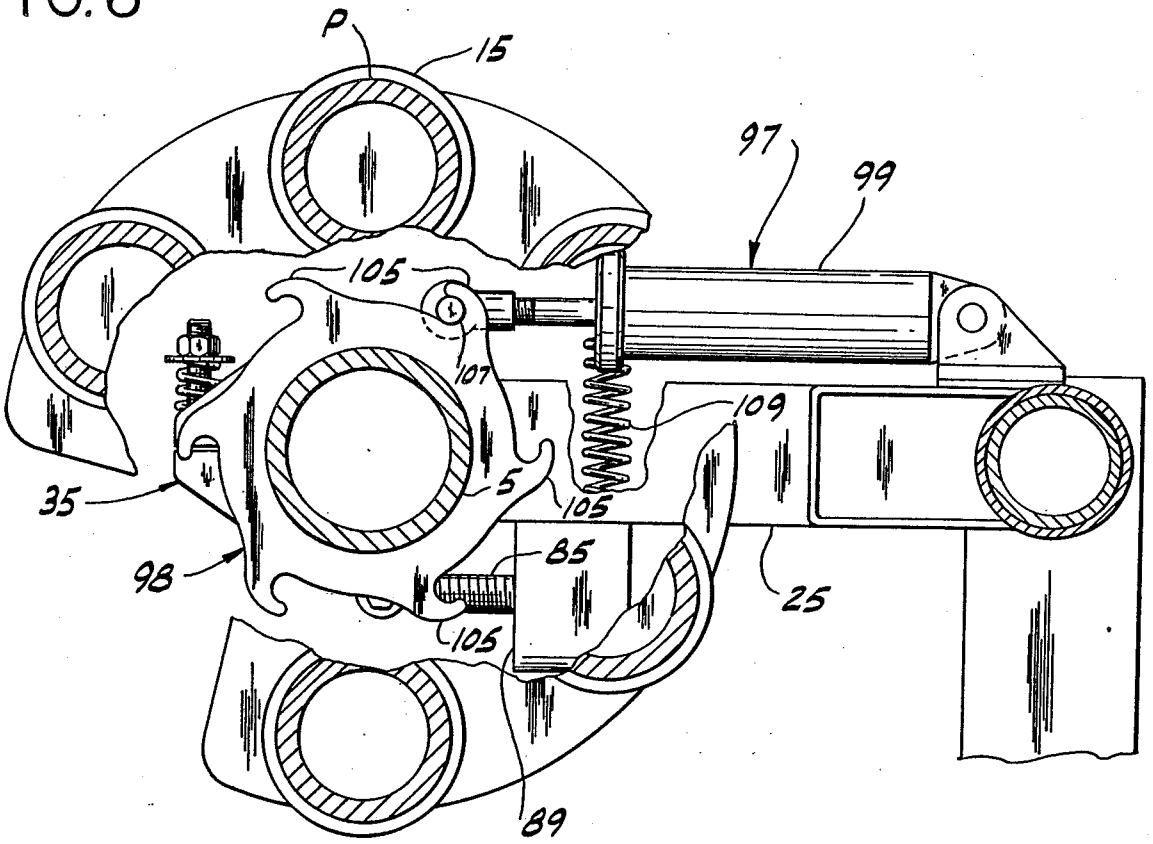
FIG. 6 is a view in section on line 6—6 of FIG. 1 with parts broken away to show detail.

The pipe handling apparatus 1 has an indexing mechanism, including the hydraulically actuated cylinder mechanism indicated generally at 97, and the ratchet wheels indicated generally at 98, to enable rotation of the magazine 3 for successively bringing pipes P into position for being removed from the magazine by the drilling apparatus D. The cylinder 99 of the hydraulic mechanism, in which the piston rod 101 is reciprocable, is pivotally mounted on the lower arm 25 of the supporting means at its end opposite the end from which the piston rod exits the cylinder. The ratchet wheels project radially outwardly from the magazine shaft 5 on either side of the brake shoes. The teeth 105 of the ratchet wheels are curved in a counterclockwise direction as shown in FIG. 6. The distal end of the piston rod has a pin 107 acting as a pawl which simultaneously engages corresponding teeth of the ratchet wheels. A spring 109 is attached to the end of the cylinder opposite its pivotally mounted end and to the attachment plate 89 acting to pivot the hydraulic mechanism in a counterclockwise direction, as shown in FIG. 6, about its pivotally mounted end, and thereby biases the pin against the periphery of the ratchet wheels.

Figure 1:
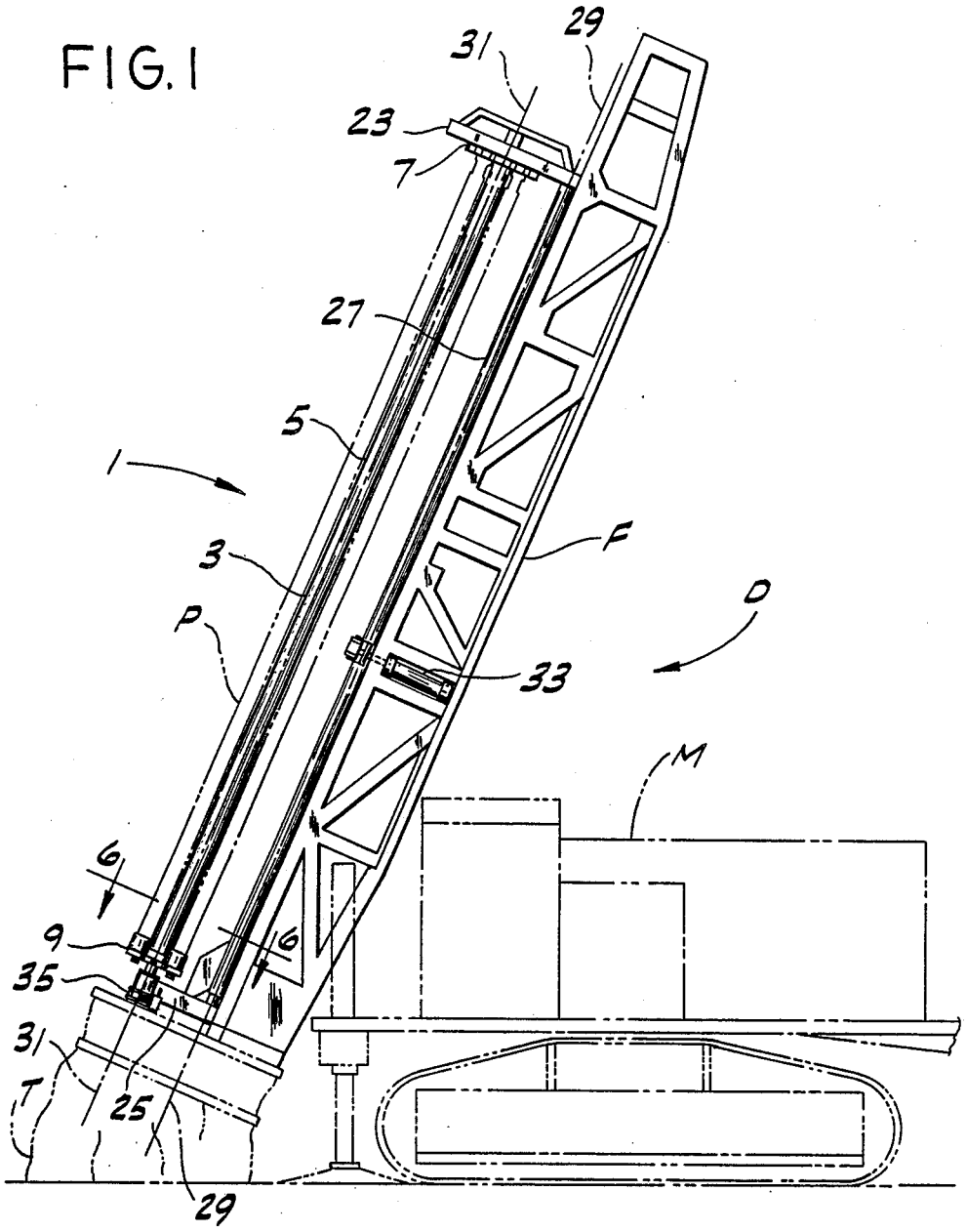
FIG. 1 is a side elevation of drilling apparatus and drill pipe handling apparatus including the present invention, with a mobile platform shown in phantom.
Figure 2:
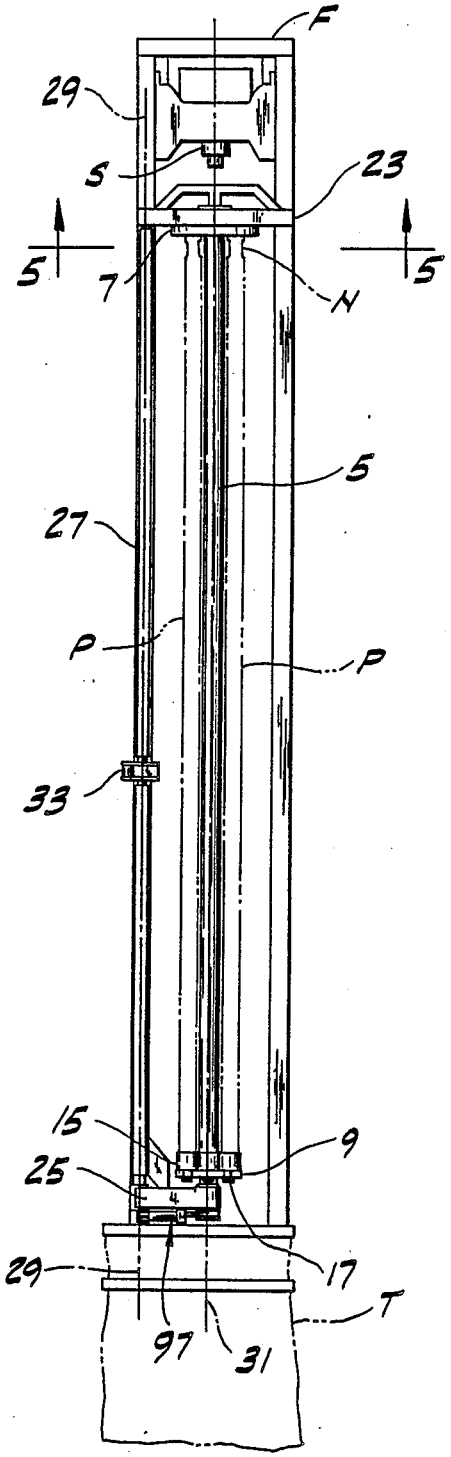
FIG. 2 is a front plan of the drill pipe handling apparatus showing the drilling apparatus frame.
Figure 3:
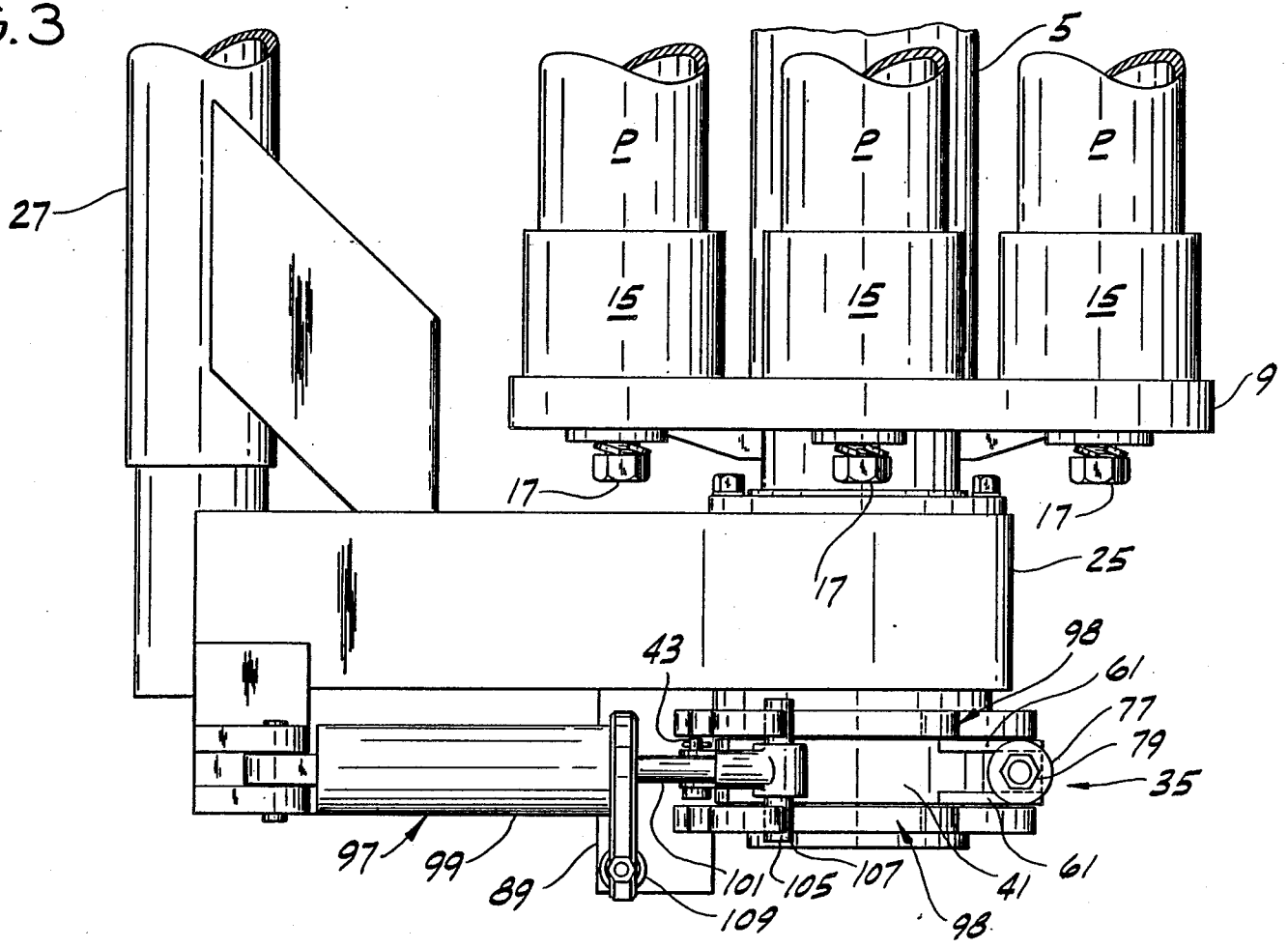
FIG. 3 is an enlarged fragment of FIG. 2 showing the lower end of the pipe handling apparatus.
Figure 4:
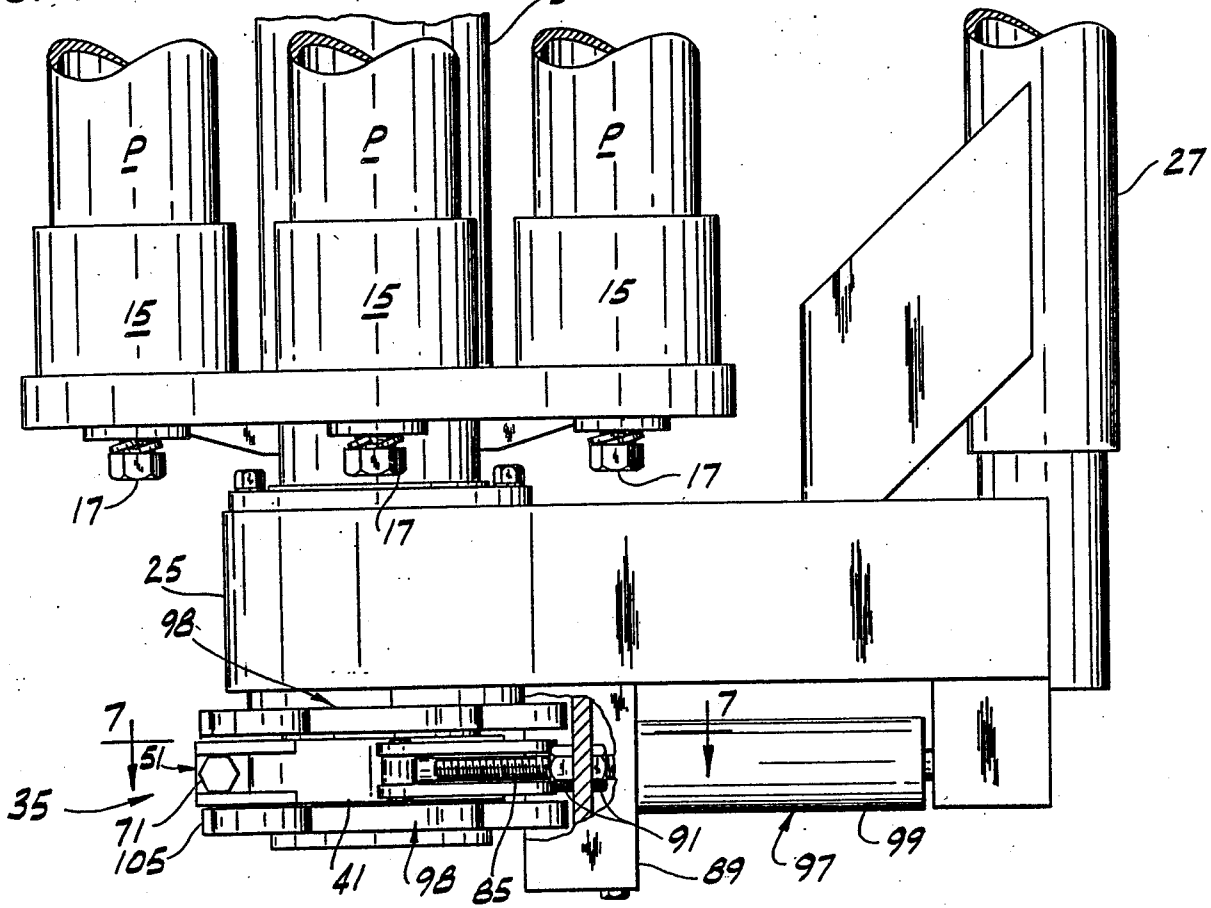
FIG. 4 is an enlarged fragment of FIG. 1 showing the lower end of the pipe handling apparatus.

In operation, the pipe handling apparatus 1 is initially in a configuration with the magazine 3 in the retracted position from the drilling apparatus frame F, as shown in FIG. 1. The piston rod 101 is also initially in its retracted position with respect to the cylinder 99 (FIGS. 3 and 6). The piston rod is extended, with the pin 107 generally engaging the periphery of both ratchet wheels. The pin passes over the next teeth 105 (in the counterclockwise direction as shown in FIG. 6) and is drawn against the periphery of the ratchet wheels beyond the base of the teeth by the spring 109. The piston rod is then retracted and the pin engages the teeth, applying sufficient torque to the magazine shaft 5 to overcome the braking force of the brake shoes 41, and rotates the magazine shaft in a clockwise direction (as shown in FIG. 6).

With the next drill pipe P in position, the magazine 3 is rotated about the support shaft 27 and into a delivery position in the drilling apparatus frame F by hydraulic means 33. The drill stem S of the drilling apparatus D is slidable in the frame F in directions parallel to the magazine shaft 5. When the magazine is swung into the frame, the drill stem is located above the magazine (see FIG. 2), and is generally coaxial with the drill pipe to be removed from the magazine. The external surface of the stem is threaded and engages internal threads on the drill pipe as the stem moves downward. Once engaged, the stem moves upward, simultaneously lifting the lower end of the pipe out of the cup 15 and positioning the neck N of the pipe P in the notch 19 in the upper head 7 of the magazine. The magazine is then swung back to the retracted position by the hydraulic means 33 leaving the removed pipe with the drilling apparatus to be drilled into the ground.

Once the first drill pipe is removed, the magazine is rotationally unbalanced as a result of the magazine being disposed at an angle off vertical. When the magazine is rotated to position the next pipe for delivery to the drilling apparatus the unbalanced weight of the remaining pipes tends to cause the magazine to overrotate. Absent the braking force of the brake shoes, the magazine would tend to rotate more than one pipe position as it is turned by the indexing mechanism (clockwise as shown in FIG. 6), and would then have to be indexed completely around in order to position the proper pipe for delivery into the drilling apparatus. However, in the pipe handling apparatus of this invention, the brake shoes apply sufficient force to the magazine shaft to hold the rotational position of the magazine against the weight of the unbalanced magazine. The brake shoes hold the shaft despite the presence of water, which may accumulate on the shaft in inclement weather, hydraulic fluid or other oils on the shaft.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Drill pipe handling apparatus comprising:

a magazine for holding a plurality of lengths of drill pipe and delivering each pipe into position for its removal by drilling apparatus which is operable to drill the pipe into the ground at an angle off vertical, said magazine comprising a center shaft and upper and lower heads on the shaft, said heads having means for holding a plurality of pipes in position generally parallel to the center shaft with each pipe adapted to be removed from the magazine by the drilling apparatus, means supporting the shaft for movement of the magazine relative to the drilling apparatus with the shaft at an angle off vertical between a retracted position relative to the drilling apparatus and a delivery position wherein a pipe is aligned with the drilling apparatus for removing the pipe therefrom, and for rotation of the magazine relative to the supporting means for successively bringing pipes held by the magazine into position for being removed from the magazine by the drilling apparatus, and means for holding the shaft against rotation such as might otherwise occur when the magazine is in retracted position due to the shaft being at an angle off vertical, and the magazine thereby being unbalanced, said means comprising a brake for the shaft located below the lower head, said brake comprising two generally interiorly semicylindrical brake shoes pivotally interconnected for swinging movement relative to one another on an axis generally parallel to the shaft axis between an open position for application thereof around the shaft and removal thereof from the shaft and a closed position surrounding the shaft with the interior semicylindrical surfaces of said shoes in frictional engagement with the shaft for preventing rotation of the shaft such as might otherwise occur due to the shaft being at an angle off vertical and the magazine thereby being unbalanced, while enabling rotation of the magazine for successively bringing pipes held in the magazine into position for being removed from the magazine by the drilling apparatus, means for attachment of the shoes to the supporting means for the shaft below the lower head, and spring means for drawing the two shoes together when the shoes are applied around the shaft, said spring means being disengageable from the shoes for the opening of the shoes and engageable with the shoes following application of the shoes around the shaft.

2. Drill pipe handling apparatus as set forth in claim 1 wherein the brake shoes have free ends generally opposite the point of their interconnection, and wherein the spring means is disposed at the free ends of the brake shoes for drawing together the brake shoes at the free ends.

3. Drill pipe handling apparatus as set forth in claim 2 wherein the means for attachment of the brake shoes to the supporting means comprises a fastener means having first and second ends, said first end being pivotally connected to one of the shoes for swinging movement generally in a plane perpendicular to the shaft axis for facilitating application of the brake shoes around the shaft and removal of the brake shoes from the shaft, and said second end being releasably attached to the supporting means for preventing rotation of the brake shoes relative to the supporting means.

4. Drill pipe handling apparatus as set forth in claim 3 wherein the means for supporting said shaft comprises a lower arm mounted on the drilling apparatus, said shaft being pivotally mounted on the lower arm and having portions extending above and below the lower arm, and a plate having a hole therethrough mounted on said lower arm and located beneath it, and wherein the fastener means comprises a threaded rod and two nuts having larger diameters than said hole, said second end of the rod being adapted to pass through the hole and the nuts being disposed on either side of the plate for securing the rod to the plate.

5. Drill pipe handling apparatus as set forth in claim 2 wherein the brake further comprises two members each extending from the free end of each brake shoe, each said member having an opening therethrough which is substantially aligned with the opening in the other member when the free ends of the brake shoes are drawn together so that said members abut each other, and wherein the spring means comprises a bolt having a head and a threaded shank, the bolt being adapted for reception in said openings in said members when the brake shoes are substantially closed, a helical coil compression spring receiving the shank and disposed on the shank so that said members are located between one end of the spring and the bolt head, a washer on the shank engaging the other end of the spring, and a nut adapted to be threaded on the shank and engageable with the washer for adjustably compressing the spring and adjustably biasing the shoes toward a closed position.

6. Drill pipe handling apparatus as set forth in claim 5 wherein the threads on the bolt extend only part of the way up the shank from the end of the bolt opposite the head such that there is a space between the threads and the head of the bolt for limiting the compression of the spring by the nut thereby preventing overtightening of the brake shoes on said shaft.

7. Drill pipe handling apparatus as set forth in claim 1 wherein the means for attachment of the brake shoes to the supporting means comprises a fastener means having first and second ends, said first end being pivotally connected to one of the shoes for swinging movement generally in a plane perpendicular to the shaft axis for facilitating application of the brake shoes around the shaft and removal of the brake shoes from the shaft, and said second end being releasably attached to the supporting means for preventing rotation of the brake shoes relative to the supporting means.

8. Drill pipe handling apparatus as set forth in claim 7 wherein the means for supporting said shaft comprises a lower arm mounted on the drilling apparatus, said shaft being pivotally mounted on the lower arm and having portions extending above and below the lower arm, and a plate having a hole therethrough mounted on said lower arm and located beneath it, and wherein the fastener means comprises a threaded rod and two nuts having larger diameters than said hole, said second end of the rod being adapted to pass through the hole and the nuts being disposed on either side of the plate for securing the rod to the plate.

9. Drill pipe handling apparatus comprising:

a magazine for holding a plurality of lengths of drill pipe and delivering each pipe into position for its removal by drilling apparatus which is operable to drill the pipe into the ground at an angle off vertical, said magazine comprising a center shaft and upper and lower heads on the shaft, said heads having means for holding a plurality of pipes in position generally parallel to the center shaft with each pipe adapted to be removed from the magazine by the drilling apparatus, means supporting the shaft for movement of the magazine relative to the drilling apparatus with the shaft at an angle off vertical between a retracted position relative to the drilling apparatus and a delivery position wherein a pipe is aligned with the drilling apparatus for removing the pipe therefrom, and for rotation of the magazine relative to the supporting means for successively bringing pipes held by the magazine into position for being removed from the magazine by the drilling apparatus, and means for holding the shaft against rotation such as might otherwise occur when the magazine is in retracted position due to the shaft being at an angle off vertical, and the magazine thereby being unbalanced, said means comprising a brake for the shaft located below the lower head, said brake comprising two generally interiorly semicylindrical brake shoes and brake lining material substantially covering said interior semicylindric surfaces, the shoes being pivotally interconnected for swinging movement relative to one another on an axis generally parallel to the shaft axis between an open position for application thereof around the shaft and removal thereof from the shaft and a closed position surrounding the shaft with the brake lining covering the interior semicylindrical surfaces of said shoes in frictional engagement with the shaft for preventing rotation of the shaft such as might otherwise occur due to the shaft being at an angle off vertical and the magazine thereby being unbalanced, while enabling rotation of the magazine for successively bringing pipes held in the magazine into position for being removed from the magazine by the drilling apparatus, means for attachment of the shoes to the supporting means for the shaft below the lower head, and spring means for drawing the two shoes together when the shoes are applied around the shaft, said spring means being disengageable from its shoes for the opening of the shoes and engageable with the shoes following application of the shoes around the shaft.

10. Drill pipe handling apparatus as set forth in claim 9 wherein the area enclosed by the brake shoes when the shoes are drawn together in a fully closed position is less than the cross sectional area of said shaft, and wherein the spring means is located at the free ends of the brake shoes and is adapted for adjusting the force applied to draw the two shoes together into a closed position so that the brake may be closed tightly against the shaft despite a reduction in thickness of the brake lining material because of wear.

11. Drill pipe handling apparatus as set forth in claim 10 wherein the means for attachment of the brake shoes to the supporting means comprises a fastener means having first and second ends, said first end being pivotally connected to one of the shoes for swinging movement generally in a plane perpendicular to the shaft axis for facilitating application of the brake shoes around the shaft and removal of the brake shoes from the shaft, and said second end being releasably attached to the supporting means for preventing rotation of the brake shoes relative to the supporting means.

12. Drill pipe handling apparatus as set forth in claim 11 wherein the means for supporting said shaft comprises a lower arm mounted on the drilling apparatus, said shaft being pivotally mounted on the lower arm and having portions extending above and below the lower arm, and a plate having a hole therethrough mounted on said lower arm and located beneath it, and wherein the fastener means comprises a threaded rod and two nuts having larger diameters than said hole, said second end of the rod being adapted to pass through the hole and the nuts being disposed on either side of the plate for securing the rod to the plate.

13. Drill pipe handling apparatus as set forth in claim 10 wherein the brake further comprises two members each extending from the free end of each brake shoe, each said member having an opening therethrough which is substantially aligned with the opening in the other member when the free ends of the brake shoes are drawn together so that said members abut each other, and wherein the spring means comprises a bolt having a head and a threaded shank, the bolt being adapted for reception in said openings in said members when the brake shoes are substantially closed, a helical coil compression spring receiving the shank and disposed on the shank so that said members are located between one end of the spring and the bolt head, a washer on the shank engaging the other end of the spring, and a nut adapted to be threaded on the shank and engageable with the washer for adjustably compressing the spring and adjustably biasing the shoes toward a closed position.

14. Drill pipe handling apparatus as set forth in claim 13 wherein the threads on the bolt extend only part of the way up the shank from the end of the bolt opposite the head such that there is a space between the threads and the head of the bolt for limiting the compression of the spring by the nut thereby preventing overtightening of the brake shoes on said shaft.

* * * * *